US009250590B2

(12) United States Patent
Kosaka

(10) Patent No.: US 9,250,590 B2
(45) Date of Patent: Feb. 2, 2016

(54) POWER SUPPLY DEVICE AND IMAGE FORMATION APPARATUS

(75) Inventor: Toru Kosaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/526,664

(22) Filed: Jun. 19, 2012

(65) Prior Publication Data

US 2012/0321338 A1 Dec. 20, 2012

(30) Foreign Application Priority Data

Jun. 20, 2011 (JP) ..... 2011-136261

(51) Int. Cl.
*G03G 15/00* (2006.01)

(52) U.S. Cl.
CPC ..... *G03G 15/5004* (2013.01)

(58) Field of Classification Search
CPC G03G 15/80; G03G 21/1867; G03G 15/5004
USPC ..... 399/37, 66, 88, 89, 168, 75; 310/318
See application file for complete search history.

(56) References Cited

U.S. PATENT DOCUMENTS 5,043,864 A * 8/1991 Inuzuka et al. ..... 700/81
7,548,708 B2 * 6/2009 Nagasaki et al. ..... 399/88
2005/0030687 A1 * 2/2005 Chou et al. ..... 361/91.1
2005/0244169 A1 * 11/2005 Ono ..... 399/12
2010/0104313 A1 * 4/2010 Kosaka et al. ..... 399/88
2010/0290203 A1 * 11/2010 Nagasaki ..... 361/767
2011/0097100 A1 * 4/2011 Nagasaki ..... 399/88
2011/0110681 A1 * 5/2011 Miller et al. ..... 399/109
2011/0123208 A1 * 5/2011 Inukai ..... 399/37

FOREIGN PATENT DOCUMENTS

JP 2002-374670 A 12/2002
JP 2006-330461 A 12/2006
JP 2010-148321 A 7/2010

* cited by examiner

*Primary Examiner* — Benjamin Schmitt
*Assistant Examiner* — Matthew Miller
(74) *Attorney, Agent, or Firm* — Marvin A. Motsenbocker; Mots Law, PLLC

(57) ABSTRACT

A power supply device includes a voltage output unit configured to output a DC voltage corresponding to a control signal from a first controller and an output evaluator configured to perform a judgment process of judging whether or not the DC voltage is a voltage corresponding to a set value received from the fist controller, and to output a result of the judgment to the first controller. The output evaluator includes a storage for storing correspondence information which shows a correspondence relationship between the set value and a voltage value of the DC voltage outputted from the voltage output unit. The output evaluator performs the judgment process by outputting the correspondence information to the first controller, and receiving a set value determined on the basis of the correspondence information from the first controller.

27 Claims, 13 Drawing Sheets

FIG. 6

| DAC SET VALUE | OUTPUT VOLTAGE(V) | DAC SET VALUE | OUTPUT VOLTAGE(V) | DAC SET VALUE | OUTPUT VOLTAGE(V) | DAC SET VALUE | OUTPUT VOLTAGE(V) | DAC SET VALUE | OUTPUT VOLTAGE(V) | DAC SET VALUE | OUTPUT VOLTAGE(V) | DAC SET VALUE | OUTPUT VOLTAGE(V) | DAC SET VALUE | OUTPUT VOLTAGE(V) |
|---|---|---|---|---|---|---|---|---|---|---|---|---|---|---|---|
| 00hex | 130 | 20hex | 1210 | 40hex | 2420 | 60hex | 3630 | 80hex | 4520 | A0hex | 5810 | C0hex | 7190 | E0hex | 7410 |
| 01hex | 130 | 21hex | 1250 | 41hex | 2460 | 61hex | 3650 | 81hex | 4560 | A1hex | 5850 | C1hex | 7240 | E1hex | 7410 |
| 02hex | 130 | 22hex | 1280 | 42hex | 2500 | 62hex | 3700 | 82hex | 4580 | A2hex | 5890 | C2hex | 7280 | E2hex | 7410 |
| 03hex | 130 | 23hex | 1320 | 43hex | 2530 | 63hex | 3740 | 83hex | 4930 | A3hex | 6140 | C3hex | 7330 | E3hex | 7410 |
| 04hex | 140 | 24hex | 1360 | 44hex | 2570 | 64hex | 3760 | 84hex | 4970 | A4hex | 6180 | C4hex | 7370 | E4hex | 7410 |
| 05hex | 180 | 25hex | 1400 | 45hex | 2620 | 65hex | 3810 | 85hex | 5000 | A5hex | 6200 | C5hex | 7410 | E5hex | 7410 |
| 06hex | 210 | 26hex | 1430 | 46hex | 2640 | 66hex | 3850 | 86hex | 5040 | A6hex | 6250 | C6hex | 7410 | E6hex | 7410 |
| 07hex | 260 | 27hex | 1470 | 47hex | 2680 | 67hex | 3870 | 87hex | 5080 | A7hex | 6290 | C7hex | 7410 | E7hex | 7410 |
| 08hex | 290 | 28hex | 1500 | 48hex | 2730 | 68hex | 3920 | 88hex | 5100 | A8hex | 6310 | C8hex | 7410 | E8hex | 7410 |
| 09hex | 330 | 29hex | 1540 | 49hex | 2750 | 69hex | 3960 | 89hex | 5170 | A9hex | 6360 | C9hex | 7410 | E9hex | 7410 |
| 0Ahex | 360 | 2Ahex | 1580 | 4Ahex | 2790 | 6Ahex | 4020 | 8Ahex | 5210 | AAhex | 6400 | CAhex | 7410 | EAhex | 7410 |
| 0Bhex | 400 | 2Bhex | 1620 | 4Bhex | 2840 | 6Bhex | 4050 | 8Bhex | 5240 | ABhex | 6420 | CBhex | 7410 | EBhex | 7410 |
| 0Chex | 440 | 2Chex | 1650 | 4Chex | 2880 | 6Chex | 4090 | 8Chex | 5280 | AChex | 6470 | CChex | 7410 | EChex | 7410 |
| 0Dhex | 510 | 2Dhex | 1690 | 4Dhex | 2930 | 6Dhex | 4140 | 8Dhex | 5320 | ADhex | 6500 | CDhex | 7410 | EDhex | 7410 |
| 0Ehex | 550 | 2Ehex | 1720 | 4Ehex | 2980 | 6Ehex | 4180 | 8Ehex | 5350 | AEhex | 6530 | CEhex | 7410 | EEhex | 7410 |
| 0Fhex | 580 | 2Fhex | 1770 | 4Fhex | 2990 | 6Fhex | 4220 | 8Fhex | 5390 | AFhex | 6580 | CFhex | 7410 | EFhex | 7410 |
| 10hex | 620 | 30hex | 1810 | 50hex | 3040 | 70hex | 4250 | 90hex | 5430 | B0hex | 6610 | D0hex | 7410 | F0hex | 7410 |
| 11hex | 660 | 31hex | 1840 | 51hex | 3080 | 71hex | 4280 | 91hex | 5460 | B1hex | 6640 | D1hex | 7410 | F1hex | 7410 |
| 12hex | 690 | 32hex | 1880 | 52hex | 3100 | 72hex | 4310 | 92hex | 5500 | B2hex | 6690 | D2hex | 7410 | F2hex | 7410 |
| 13hex | 730 | 33hex | 1920 | 53hex | 3150 | 73hex | 4360 | 93hex | 5540 | B3hex | 6710 | D3hex | 7410 | F3hex | 7410 |
| 14hex | 770 | 34hex | 1950 | 54hex | 3190 | 74hex | 4400 | 94hex | 5570 | B4hex | 6750 | D4hex | 7410 | F4hex | 7410 |
| 15hex | 810 | 35hex | 2000 | 55hex | 3210 | 75hex | 4420 | 95hex | 5610 | B5hex | 6790 | D5hex | 7410 | F5hex | 7410 |
| 16hex | 840 | 36hex | 2030 | 56hex | 3260 | 76hex | 4470 | 96hex | 5630 | B6hex | 6820 | D6hex | 7410 | F6hex | 7410 |
| 17hex | 880 | 37hex | 2070 | 57hex | 3300 | 77hex | 4490 | 97hex | 5680 | B7hex | 6860 | D7hex | 7410 | F7hex | 7410 |
| 18hex | 910 | 38hex | 2110 | 58hex | 3320 | 78hex | 4530 | 98hex | 5720 | B8hex | 6900 | D8hex | 7410 | F8hex | 7410 |
| 19hex | 960 | 39hex | 2160 | 59hex | 3370 | 79hex | 4570 | 99hex | 5740 | B9hex | 6930 | D9hex | 7410 | F9hex | 7410 |
| 1Ahex | 990 | 3Ahex | 2190 | 5Ahex | 3390 | 7Ahex | 4600 | 9Ahex | 5790 | BAhex | 6970 | DAhex | 7410 | FAhex | 7410 |
| 1Bhex | 1030 | 3Bhex | 2220 | 5Bhex | 3430 | 7Bhex | 4640 | 9Bhex | 5830 | BBhex | 7020 | DBhex | 7410 | FBhex | 7410 |
| 1Chex | 1060 | 3Chex | 2270 | 5Chex | 3480 | 7Chex | 4690 | 9Chex | 5850 | BChex | 7040 | DChex | 7410 | FChex | 7410 |
| 1Dhex | 1100 | 3Dhex | 2310 | 5Dhex | 3520 | 7Dhex | 4710 | 9Dhex | 5900 | BDhex | 7080 | DDhex | 7410 | FDhex | 7410 |
| 1Ehex | 1140 | 3Ehex | 2350 | 5Ehex | 3550 | 7Ehex | 4750 | 9Ehex | 5930 | BEhex | 7130 | DEhex | 7410 | FEhex | 7410 |
| 1Fhex | 1170 | 3Fhex | 2380 | 5Fhex | 3590 | 7Fhex | 4800 | 9Fhex | 5960 | BFhex | 7150 | DFhex | 7410 | FFhex | 7410 |

FIG. 11

| TARGET SET VALUE | OUTPUT VOLTAGE (V) | TARGET SET VALUE | OUTPUT VOLTAGE (V) | TARGET SET VALUE | OUTPUT VOLTAGE (V) | TARGET SET VALUE | OUTPUT VOLTAGE (V) | TARGET SET VALUE | OUTPUT VOLTAGE (V) | TARGET SET VALUE | OUTPUT VOLTAGE (V) | TARGET SET VALUE | OUTPUT VOLTAGE (V) | TARGET SET VALUE | OUTPUT VOLTAGE (V) |
|---|---|---|---|---|---|---|---|---|---|---|---|---|---|---|---|
| 00hex | 130 | 20hex | 1210 | 40hex | 2420 | 60hex | 3630 | 80hex | 4620 | A0hex | 6010 | C0hex | 7190 | E0hex | 7410 |
| 01hex | 130 | 21hex | 1250 | 41hex | 2460 | 61hex | 3650 | 81hex | 4650 | A1hex | 6050 | C1hex | 7240 | E1hex | 7410 |
| 02hex | 130 | 22hex | 1280 | 42hex | 2500 | 62hex | 3700 | 82hex | 4690 | A2hex | 6090 | C2hex | 7280 | E2hex | 7410 |
| 03hex | 130 | 23hex | 1320 | 43hex | 2530 | 63hex | 3740 | 83hex | 4730 | A3hex | 6140 | C3hex | 7330 | E3hex | 7410 |
| 04hex | 140 | 24hex | 1360 | 44hex | 2570 | 64hex | 3760 | 84hex | 4970 | A4hex | 6180 | C4hex | 7370 | E4hex | 7410 |
| 05hex | 160 | 25hex | 1400 | 45hex | 2620 | 65hex | 3810 | 85hex | 5000 | A5hex | 6200 | C5hex | 7410 | E5hex | 7410 |
| 06hex | 210 | 26hex | 1430 | 46hex | 2640 | 66hex | 3850 | 86hex | 5040 | A6hex | 6250 | C6hex | 7410 | E6hex | 7410 |
| 07hex | 250 | 27hex | 1470 | 47hex | 2680 | 67hex | 3870 | 87hex | 5080 | A7hex | 6290 | C7hex | 7410 | E7hex | 7410 |
| 08hex | 290 | 28hex | 1500 | 48hex | 2730 | 68hex | 3920 | 88hex | 5100 | A8hex | 6310 | C8hex | 7410 | E8hex | 7410 |
| 09hex | 330 | 29hex | 1540 | 49hex | 2750 | 69hex | 3960 | 89hex | 5170 | A9hex | 6360 | C9hex | 7410 | E9hex | 7410 |
| 0Ahex | 360 | 2Ahex | 1580 | 4Ahex | 2790 | 6Ahex | 4020 | 8Ahex | 5210 | AAhex | 6400 | CAhex | 7410 | EAhex | 7410 |
| 0Bhex | 400 | 2Bhex | 1620 | 4Bhex | 2840 | 6Bhex | 4060 | 8Bhex | 5240 | ABhex | 6420 | CBhex | 7410 | EBhex | 7410 |
| 0Chex | 440 | 2Chex | 1650 | 4Chex | 2880 | 6Chex | 4090 | 8Chex | 5280 | AChex | 6470 | CChex | 7410 | EChex | 7410 |
| 0Dhex | 510 | 2Dhex | 1690 | 4Dhex | 2930 | 6Dhex | 4140 | 8Dhex | 5320 | ADhex | 6520 | CDhex | 7410 | EDhex | 7410 |
| 0Ehex | 550 | 2Ehex | 1720 | 4Ehex | 2960 | 6Ehex | 4180 | 8Ehex | 5350 | AEhex | 6570 | CEhex | 7410 | EEhex | 7410 |
| 0Fhex | 580 | 2Fhex | 1770 | 4Fhex | 2990 | 6Fhex | 4200 | 8Fhex | 5390 | AFhex | 6580 | CFhex | 7410 | EFhex | 7410 |
| 10hex | 620 | 30hex | 1810 | 50hex | 3040 | 70hex | 4250 | 90hex | 5430 | B0hex | 6610 | D0hex | 7410 | F0hex | 7410 |
| 11hex | 650 | 31hex | 1840 | 51hex | 3080 | 71hex | 4280 | 91hex | 5460 | B1hex | 6640 | D1hex | 7410 | F1hex | 7410 |
| 12hex | 690 | 32hex | 1880 | 52hex | 3100 | 72hex | 4310 | 92hex | 5500 | B2hex | 6680 | D2hex | 7410 | F2hex | 7410 |
| 13hex | 730 | 33hex | 1920 | 53hex | 3150 | 73hex | 4360 | 93hex | 5540 | B3hex | 6710 | D3hex | 7410 | F3hex | 7410 |
| 14hex | 770 | 34hex | 1960 | 54hex | 3190 | 74hex | 4400 | 94hex | 5570 | B4hex | 6750 | D4hex | 7410 | F4hex | 1650 |
| 15hex | 810 | 35hex | 2000 | 55hex | 3210 | 75hex | 4420 | 95hex | 5610 | B5hex | 6790 | D5hex | 7410 | F5hex | 7410 |
| 16hex | 840 | 36hex | 2030 | 56hex | 3260 | 76hex | 4470 | 96hex | 5630 | B6hex | 6820 | D6hex | 7410 | F6hex | 7410 |
| 17hex | 880 | 37hex | 2070 | 57hex | 3300 | 77hex | 4490 | 97hex | 5680 | B7hex | 6860 | D7hex | 7410 | F7hex | 7410 |
| 18hex | 910 | 38hex | 2110 | 58hex | 3320 | 78hex | 4530 | 98hex | 5720 | B8hex | 6900 | D8hex | 7410 | F8hex | 7410 |
| 19hex | 950 | 39hex | 2150 | 59hex | 3370 | 79hex | 4570 | 99hex | 5740 | B9hex | 6930 | D9hex | 7410 | F9hex | 7410 |
| 1Ahex | 990 | 3Ahex | 2190 | 5Ahex | 3390 | 7Ahex | 4600 | 9Ahex | 5780 | BAhex | 6970 | DAhex | 7410 | FAhex | 7410 |
| 1Bhex | 1030 | 3Bhex | 2230 | 5Bhex | 3430 | 7Bhex | 4640 | 9Bhex | 5830 | BBhex | 7020 | DBhex | 7410 | FBhex | 7410 |
| 1Chex | 1060 | 3Chex | 2270 | 5Chex | 3480 | 7Chex | 4680 | 9Chex | 5890 | BChex | 7040 | DChex | 7410 | FChex | 7410 |
| 1Dhex | 1100 | 3Dhex | 2310 | 5Dhex | 3520 | 7Dhex | 4710 | 9Dhex | 5900 | BDhex | 7080 | DDhex | 7410 | FDhex | 7410 |
| 1Ehex | 1140 | 3Ehex | 2350 | 5Ehex | 3550 | 7Ehex | 4750 | 9Ehex | 5930 | BEhex | 7130 | DEhex | 7410 | FEhex | 7410 |
| 1Fhex | 1170 | 3Fhex | 2380 | 5Fhex | 3590 | 7Fhex | 4800 | 9Fhex | 5980 | BFhex | 7150 | DFhex | 7410 | FFhex | 7410 |

POWER SUPPLY DEVICE AND IMAGE FORMATION APPARATUS

CROSS REFERENCE TO RELATED APPLICATIONS

This application claims priority based on 35 USC 119 from prior Japanese Patent Application No. 2011-136261 filed on Jun. 20, 2011, entitled "POWER SUPPLY DEVICE AND IMAGE FORMATION APPARATUS", the entire contents of which are incorporated herein by reference.

BACKGROUND OF THE INVENTION

1. Field of the Invention

This disclosure relates to a power supply device and an image formation apparatus.

2. Description of Related Art

One of conventional power supply devices used for the electrophotographic image formation apparatus is a power supply device described in Japanese Patent Application Publication No. 2010-148321, for example, which digitally controls a piezoelectric transducer drive frequency by feeding back a fraction of the output voltage of the piezoelectric transducer produced by a resistive divider; and equalizing the fed-back voltage to a preset output voltage of the digital-to-analog converter (hereafter referred as to a "DAC").

SUMMARY OF THE INVENTION

However, by receiving a DAC voltage from an external printer engine controller, the conventional power supply device has a problem that even though the power supply device outputs an output voltage corresponding to a set value which is a preset digital value, this output voltage is deviated from the set value due to factors such as an error in the reference potential, such as the ground potential, and a variation in voltage-division resistors. In addition, the output from the DAC varies due to fluctuations in the power supplied to the DAC.

With this taken into consideration, an object of an embodiment of the invention is to avoid deviation of an output voltage from a set value specifying a target voltage.

An aspect of the invention is a power supply device that includes: a voltage output unit configured to output a DC voltage corresponding to a control signal from a first controller; and an output evaluator configured to perform a judgment process for judging whether or not the DC voltage is a voltage corresponding to a set value which is received from the first controller, and to output a judgment result to the first controller. The output evaluator includes a storage configured to store correspondence information showing a correspondence relationship between the set value and a voltage value of the DC voltage outputted from the voltage output unit. The output evaluator performs the judgment process by: outputting the correspondence information to the first controller; and receiving a set value determined on the basis of the correspondence information from the first controller.

This aspect makes it possible to avoid deviation of an output voltage from the set value specifying a target voltage.

BRIEF DESCRIPTION OF THE DRAWINGS

FIG. 6 is a table showing an example of a correspondence relationship of Embodiment 1 between set values and output voltage values.

FIG. 11 is a table showing an example of a correspondence relationship of Embodiment 2 between set values and output voltage values.

DETAILED DESCRIPTION OF EMBODIMENTS

Figure 1:
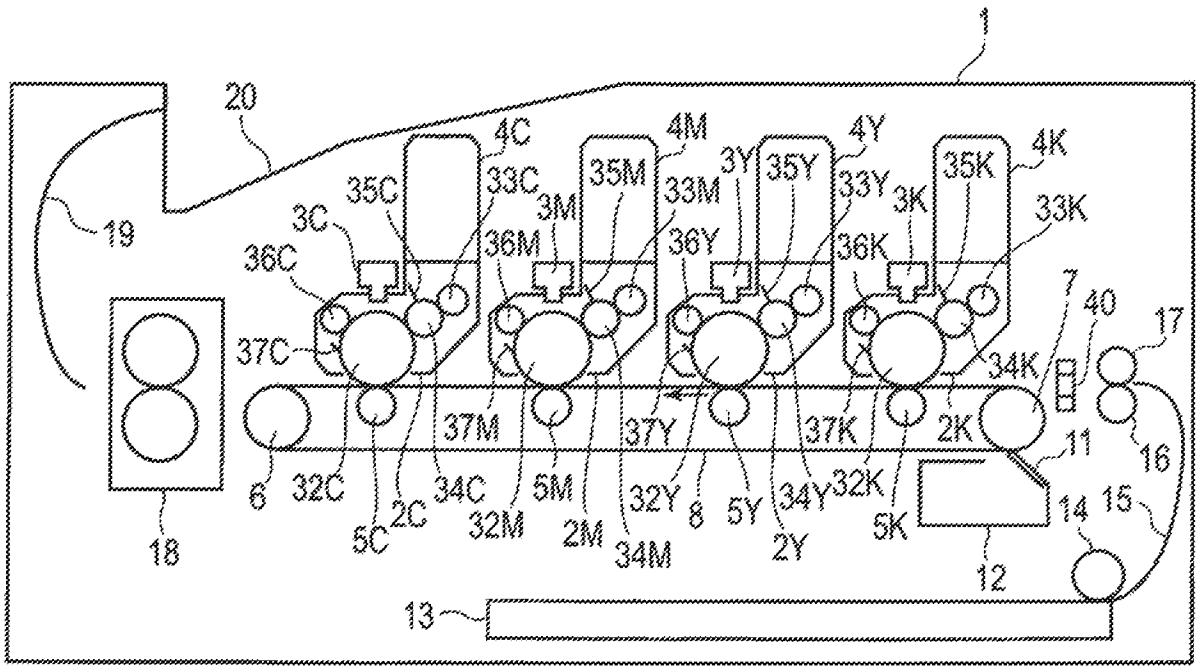
FIG. 1 is a configuration diagram schematically showing an image formation apparatus using a power supply device of either Embodiment 1 or Embodiment 2.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

Explanation of Configuration

FIG. 1 is a configuration diagram schematically showing an image formation apparatus 1 using a power supply device of either Embodiment 1 of Embodiment 2.

Image formation apparatus 1 is, for example, an electrophotographic color image formation apparatus, to which four color development units 2 (for example, black development unit 2K, yellow development unit 2Y, magenta development unit 2M and cyan development unit 2C) are detachably attached. Color development units 2 are evenly charged by color charging rollers 36 (for example, black charging roller 36K, yellow charging roller 36Y, magenta charging roller 36M and cyan charging roller 36C) which are in contact with color photosensitive drums 32 (for example, black photosensitive drum 32K, yellow photosensitive drum 32Y, magenta photosensitive drum 32M and cyan photosensitive drum 32C), respectively. Color photosensitive drums 32 thus charged form latent images with the light emission of color light-emitting device heads (hereinafter referred to as "LED heads") 3 (for example, black LED head 3K, yellow LED head 3Y, magenta LED head 3M and cyan LED head 3C), respectively.

Color supply rollers 33 (for example, black supply roller 33K, yellow supply roller 33Y, magenta supply roller 33M and cyan supply roller 33C) inside color development units 2 supply toners to color development rollers 34 (for example, black development roller 34K, yellow development roller 34Y, magenta development roller 34M and cyan development roller 34C), respectively. Toner layers are evenly formed on the surfaces of color development rollers 34 by color development blades 35 (for example, black development blade 35K, yellow development blade 35Y, magenta development blade 35M and cyan development blade 35C), respectively. The toner images are developed on color photosensitive drums 32, respectively. Color cleaning blades 37 (for example, black cleaning blade 37K, yellow cleaning blade 37Y, magenta cleaning blade 37M and cyan cleaning blade 37C) in color development units 2 clean remaining toners off color photosensitive drums 32 after the toner images are transferred, respectively.

Color toner cartridges 4 (for example, black toner cartridge 4K, yellow toner cartridge 4Y, magenta toner cartridge 4M and cyan toner cartridge 4C) are detachably attached to color channel development units 2, respectively. Color toner cartridges 4 have the structures which enable the toners inside color toner cartridges 4 to be supplied to color channel development units 2, respectively. Color transfer rollers 5 (for example, black transfer roller 5K, yellow transfer roller 5Y, magenta transfer roller 5M and cyan transfer roller 5C) are arranged in a way capable of applying biases to transfer nip sections from the back surface of transfer belt 8, respectively. Transfer belt drive roller 6 and transfer belt driven roller 7 have a structure in which: transfer belt 8 is tautly suspended between transfer belt drive roller 6 and transfer belt driven roller 7; and transfer belt 8 is capable of conveying sheet 15 as a recording medium in response to the drive of the rollers.

Transfer belt cleaning blade 11 is formed in a way capable of scraping toners from the top of transfer belt 8. The scraped toners are contained in transfer belt cleaner container 12. Sheet cassette 13 is detachably attached to image formation apparatus 1, and sheets 15 are stacked in sheet cassette 13. Hopping roller 14 carries each sheet 15 from sheet cassette 13. Register rollers 16, 17 carry sheet 16 onto transfer belt 8 at a predetermined timing. Fixation unit 18 fixes the toner images onto sheet 15 by applying heat and pressure. With the face down, sheet 15 is discharged onto delivery tray 20 by sheet guide 19.

Sheet detection sensor 40 is placed between register rollers 16, 17 and transfer belt driven roller 7. Sheet detection sensor 40 detects the passage of sheet 15 in a contact or noncontact manner. Timings at which the power supply device applies the transfer biases for the transfer are determined on the basis of relationships between the distances from the sensing position of sheet detection sensor 40 to the transfer nip sections and the sheet conveyance speed, respectively.

Figure 2:
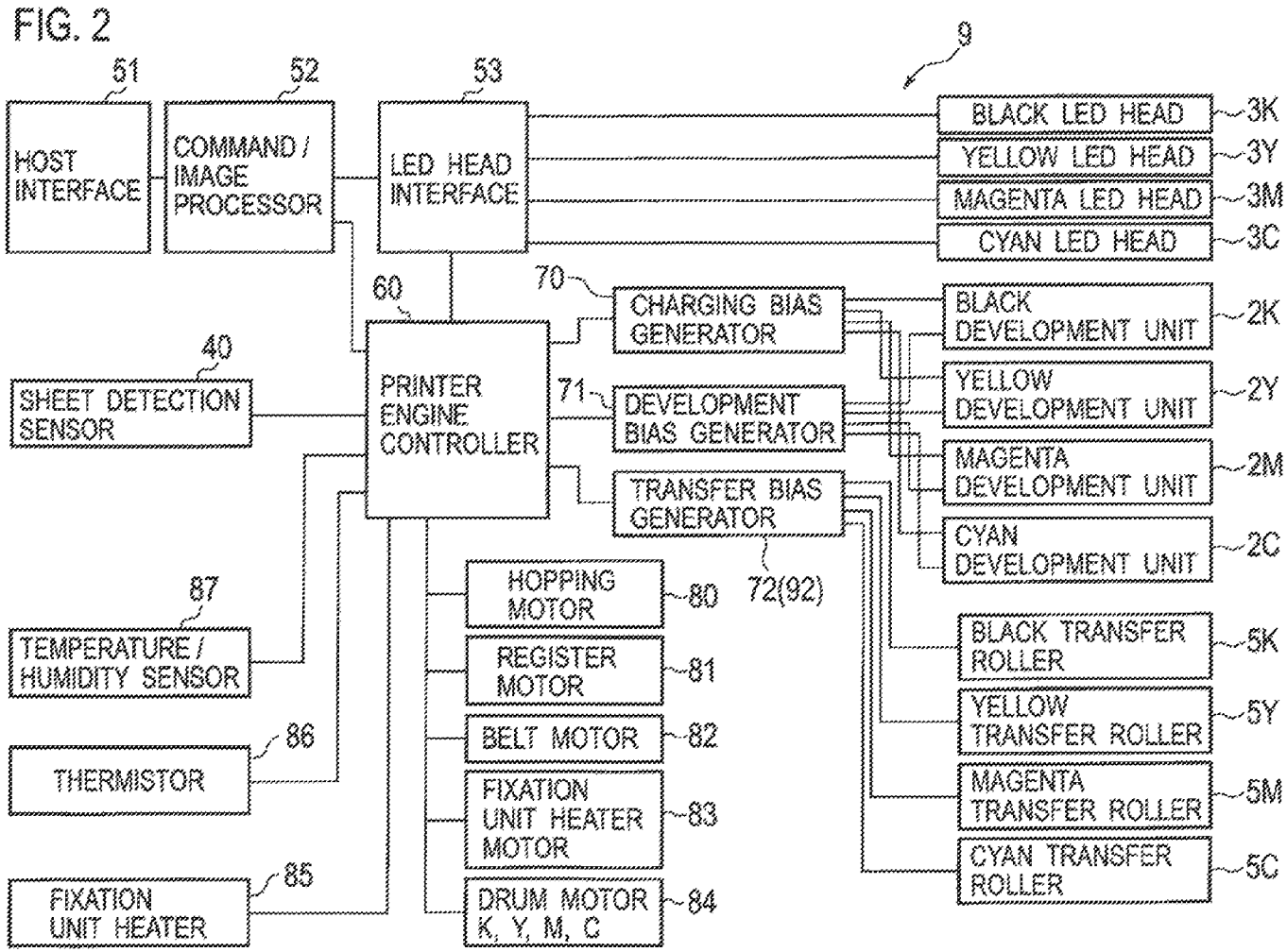
FIG. 2 is a block diagram schematically showing a configuration of a control circuit of both Embodiment 1 and Embodiment 2.

FIG. 2 is a block diagram showing a configuration of control circuit 9 in image formation apparatus 1 shown in FIG. 1. It should be noted that in FIG. 2, a parenthesized reference numeral denotes a component included in a configuration of Embodiment 2. Control circuit 9 includes host interface 51. Host interface 51 sends data to, and receives data from, command/image processor 52. Command/image processor 52 outputs image data to LED head interface 53. Head driving pulses and the like of LED head interface 53 are controlled by printer engine controller 60, and LED head interface 53 accordingly lights color LED heads 3.

On the basis of a result of the detection by sheet detection sensor 40, printer engine controller 60 sends signals to charging bias generator 70, development bias generator 71 and transfer bias generators 72, as well as causes charging bias generator 70, development bias generator 71 and transfer bias generators 72 to generate high voltages, respectively. Charging bias generator 70 and development bias generator 71 apply biases to color charging rollers 36 and color development rollers 34. Transfer bias generators 72 apply transfer biases to color transfer rollers 5, respectively. Sheet detection sensor 40 is used to control the timings at which the transfer biases are generated.

In addition, printer engine controller 60 drives hopping motor 80, register motor 81, belt motor 82, fixation unit heater motor 83 and color drum motors 84 at their respective predetermined timings. The temperature of fixation unit heater 85 is controlled by printer engine controller 60 in accordance with a detection value of thermistor 86. Furthermore, temperature/humidity sensor 87 is connected to printer engine controller 60. Printer engine controller 60 is made of a printed circuit board. This printed circuit board is, for example, a multi-layered glass epoxy circuit board including 2, 4 or 6 layers.

Figure 3:
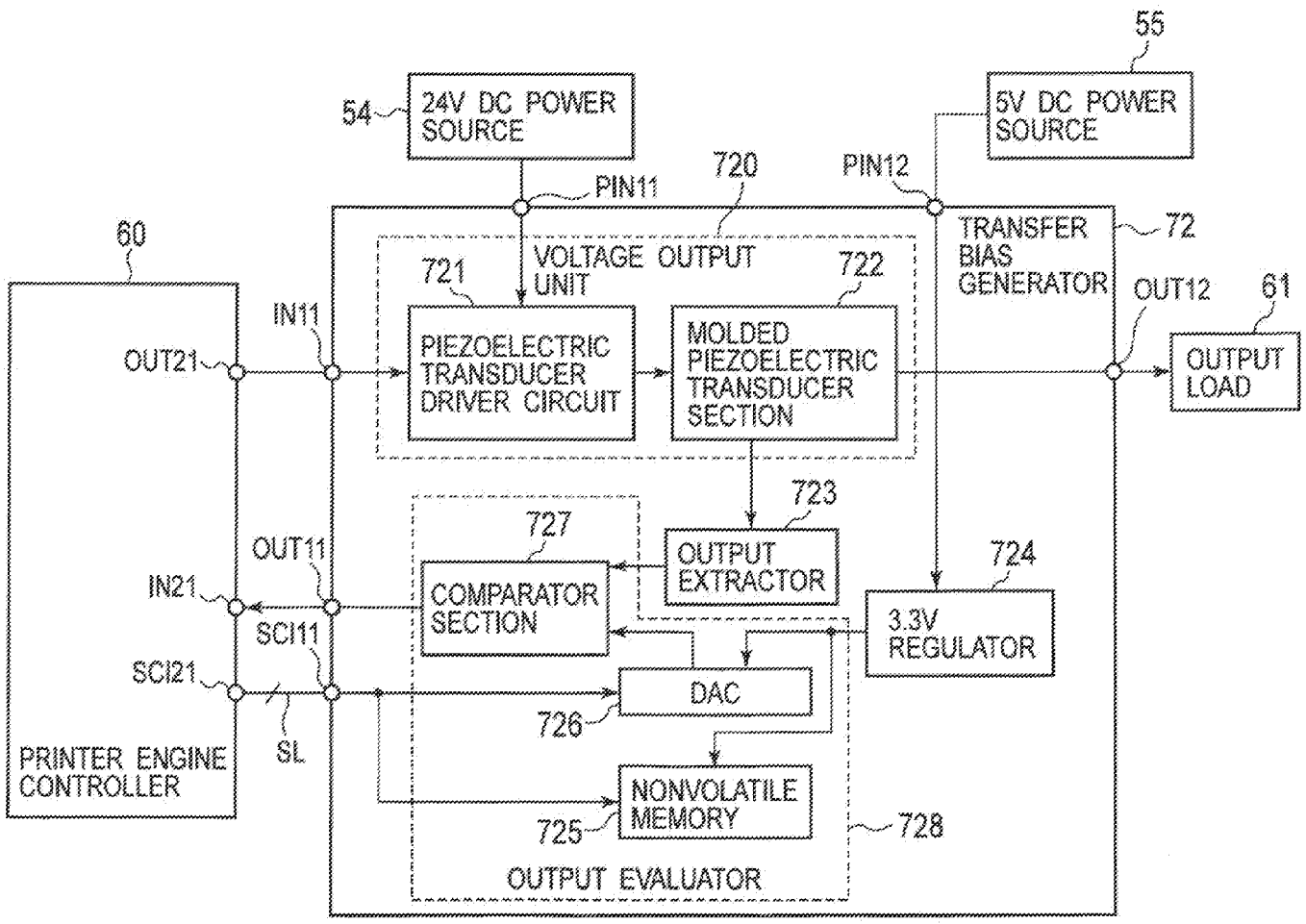
FIG. 3 is a block diagram schematically showing a configuration of a transfer bias generator of Embodiment 1.

FIG. 3 is a block diagram schematically showing a configuration of transfer bias generator 72 as a high-voltage power supply device. There is a transfer bias generator 72 for each color, although for simplicity a single transfer bias generator 72 is shown as block 72 in FIG. 2. Transfer bias generators 72 are each made of a printed circuit board. This printed circuit board is, for example, a single-layered paper phenolic circuit board or the like. In this respect, transfer bias generators 72 are provided to color transfer rollers 5, respectively. Because each color transfer bias generator 72 has the same configuration, descriptions are hereinbelow provided for one transfer bias generator 72.

Power supply input port PIN11 receives the input of "DC 24V" which is supplied from DC power source 54. Power supply input port PIN12 receives the input of "DC 5V" which is supplied from DC power source 55.

Input port IN11 receives a rectangular wave, as a piezoelectric transducer drive pulse, which is outputted from output port OUT21 of printer engine controller 60, and gives this rectangular wave to piezoelectric transducer driver circuit 721. Incidentally, this rectangular wave is used as a control signal for controlling piezoelectric transducer driver circuit 721.

Voltage output unit 720 includes piezoelectric transducer driver circuit 721 and molded piezoelectric transducer section 722. Piezoelectric transducer driver circuit 721 is a piezoelectric transducer driver for driving a piezoelectric transducer. For example, piezoelectric transducer driver circuit 721 receives the rectangular wave from input port IN11, and performs switching on the DC 24V which is received from power supply input port PIN11 in accordance with the rectangular wave. In molded piezoelectric transducer section 722, insulation molding is applied to a rectifier circuit on the secondary side of the piezoelectric transducer. This insulation molding is made by use of, for example, a resin of an insulating material. The piezoelectric transducer is a transducer configured to output a high AC voltage by raising the driving voltage by use of a resonance phenomenon of a piezoelectric vibrator made from ceramic or the like. The rectifier circuit is a converter for converting the high AC voltage, which is outputted from the piezoelectric transducer, to a high DC voltage. Output port OUT12 outputs the high DC voltage, which is outputted from molded piezoelectric transducer section 722, to output load 61.

Output extractor 723 converts the high voltage, which is outputted from molded piezoelectric transducer section 722, to a low voltage of "3.3V" or less according to the value of the high voltage by means of a resistive divider or the like. In other words, output extractor 723 is an output detector configured to output the low voltage, which changes in accordance with the high voltage outputted from molded piezoelectric transducer section 722, as an output analog voltage. Regulator 724 converts "DC 5V," which is received via power supply input port PIN12, to "DC 3.3V," and outputs the resultant "DC 3.3V." Regulator 724 is, for example, a low saturation type regulator, and its output precision has only a margin of error of plus or minus one percentage point. Nonvolatile memory 725 is a storage into which printer engine controller 60 writes information, and from which printer engine controller 60 reads information stored there, and over which printer engine controller 60 rewrites information stored there. In this embodiment, correspondence information used for printer engine controller 60 to determine a set value by using a set voltage value is stored in nonvolatile memory 725. Incidentally, in this embodiment, the correspondence information means a first value and a second value which are needed to calculate the set value from the set voltage value. In addition, the correspondence information is made unique to each transfer bias generator 72 as the high-voltage power supply device.

DAC 726 outputs an analog voltage corresponding to the set value which is given from serial port SCI11. In this respect, DAC 726 outputs a target analog voltage which is an analog voltage corresponding to the high voltage to be outputted from molded piezoelectric transducer section 722. For example, in the case where an 8-bit value "40hex" is given to DAC 726 from serial port SCI11, DAC 726 outputs "0.828V" as the target analog voltage on the basis of Expression (1) given below.

$$(40\text{hex} \div FF\text{hex}) \times 3.3\text{V} = 0.828\text{V} \qquad \text{Ex. (1)}$$

Comparator section 727 compares the output analog voltage outputted from output extractor 723 and the target analog voltage outputted from DAC 726, as well as outputs a result of this comparison to input port 21 of printer engine controller 60 via output port OUT11. In this respect, nonvolatile memory 725, DAC 726 and comparator section 727 constitute output evaluator 728. Serial port SCI11 is connected to serial port SCI21 of printer engine controller 60 through serial line SL. Serial line SL is formed from: three lines consisting of a clock line, a sending line and a receiving line; or two lines consisting of a clock line and a sending/receiving line.

Printer engine controller 60 includes output port OUT21, input port IN21 and serial port SCI21. Printer engine controller 60 outputs the rectangular wave as the piezoelectric transducer drive pulse from output port OUT21. In addition, printer engine controller 60 acquires the first value and the second value from nonvolatile memory 725 via serial port SCI21. Subsequently, using these values, printer engine controller 60 calculates the set value which is an 8-bit digital value from the value of the high voltage outputted from corresponding transfer bias generator 72, and outputs this set value from serial port SCI21. Moreover, printer engine controller 60 acquires the result of the comparison from comparator section 727 via input port IN21, and controls the frequency of the rectangular wave to be outputted from output port OUT21 on the basis of the result of the comparison.

The single-color case is described using FIG. 3. For the four-color case, it suffices that: four power supply input ports PIN11, four power supply input ports PIN12, four input ports IN11, four output ports OUT11, four output ports OUT21, four piezoelectric transducer driver circuits 721, four molded piezoelectric transducer sections 722, four output extractors 723 and four comparator sections 727 are provided; and one DAC 726, one nonvolatile memory 725, one regulator 724 and one serial port SCI11 are provided.

Figure 4:
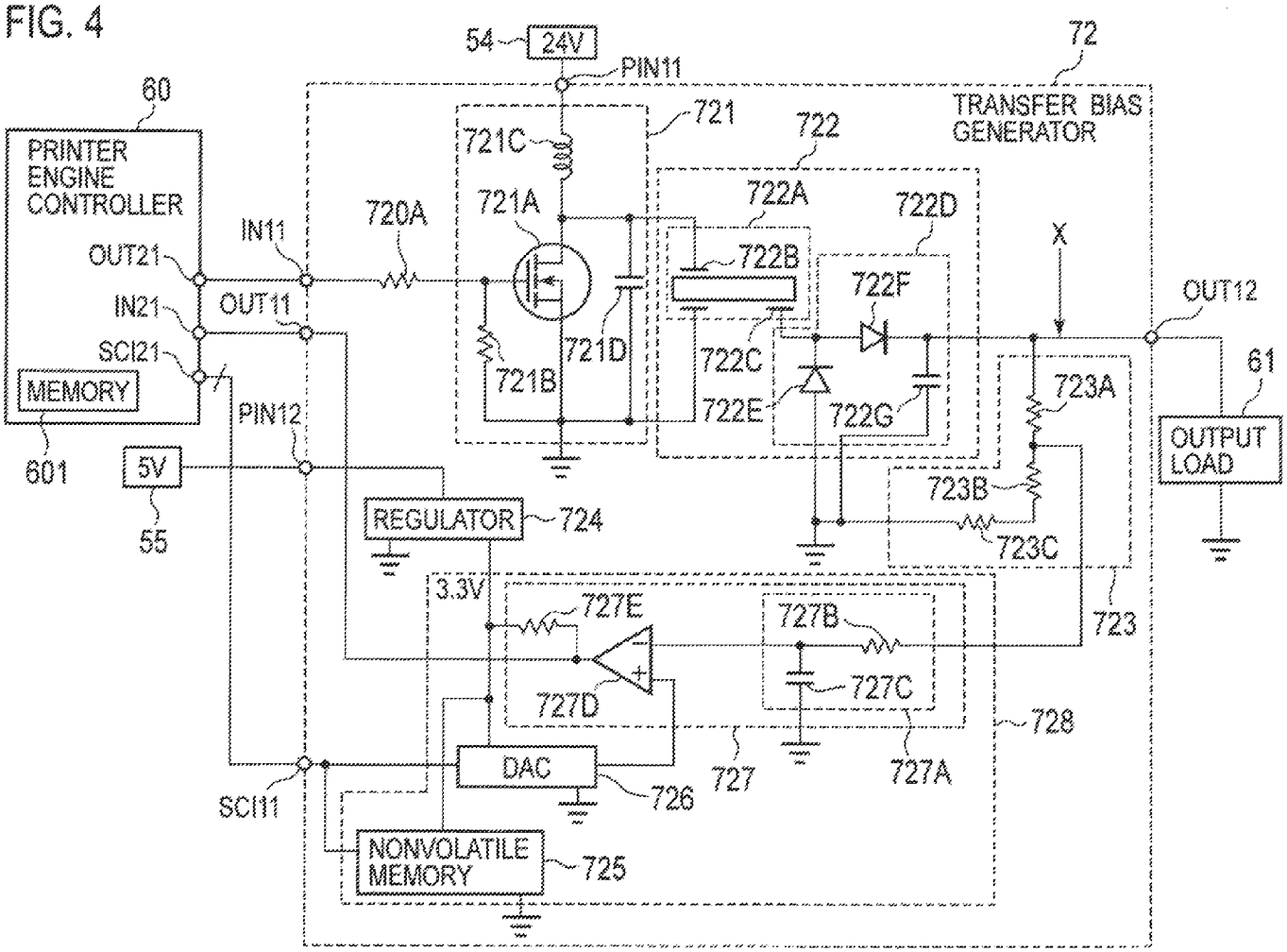
FIG. 4 is a circuit diagram schematically showing a circuit configuration of the transfer bias generator of Embodiment 1.

FIG. 4 is a circuit diagram schematically showing a circuit configuration of transfer bias generator 72 shown in FIG. 3.

Piezoelectric transducer driver circuit 721 is connected to input port IN11 via resistor 720A. Piezoelectric transducer driver circuit 721 includes power transistor (for example, an N-channel power MOSFET (hereinafter referred to as an "NMOS") 721A serving as a switching element. Resistor 721B for short-circuit prevention is connected between the gate and source of NMOS 721A. The drain of NMOS 721A is connected to power supply input port PIN11 via inductor (coil) 721C. Capacitor 721D is connected in parallel between the drain and source of NMOS 721A. Capacitor 721D and inductor 721C constitute a resonance circuit. Once the rectangular wave from printer engine controller 60 is inputted into the gate of NMOS 721A, NMOS 721A performs switching on the "DC 24V", followed by resonance due to the resonance circuit. Hence, a driving voltage with a half-sine wave whose peak is approximately 100 AC volts is outputted.

Molded piezoelectric transducer section 722 is formed from piezoelectric transducer 722A and rectifier circuit 722D packaged in a resin case in the inside of which resin is filled in order to prevent discharge and the like so that each component is covered with the resin. Incidentally, no resin is filled in piezoelectric transducer 722A because piezoelectric transducer 722A raises the voltage due to its vibration. Primary-side input terminal 722B of piezoelectric transducer 722A is connected to the output of the resonance circuit of piezoelectric transducer driver circuit 721. An AC high voltage of "0 to several kilovolts" is outputted from secondary-side output terminal 722C of piezoelectric transducer 722A in accordance with the switching frequency of NMOS 721A. Rectifier circuit 722D for the AC-to-DC conversion is connected to secondary-side output terminal 722C of piezoelectric transducer 722A. Rectifier circuit 722D is a circuit configured to convert the AC high voltage, which is outputted from secondary-side output terminal 722C of piezoelectric transducer 722A, to the DC high voltage, and to output the DC high voltage. Rectifier circuit 722D includes diodes 722E, 722F and capacitor 722G. A corresponding one of transfer rollers 5 which are output load 61 is connected to the output of rectifier circuit 722D via output port OUT12. In addition, output extractor 723 is connected to the output of rectifier circuit 722D.

Output extractor 723 includes voltage-division resistors 723A, 723B, 723C. Voltage-division resistor 723A, together with molded piezoelectric transducer section 722, is sealed in the resin case. The resistance value of voltage-division resistor 723A is "100 MΩ"; the resistance value of voltage-division 723B is "32 kΩ"; and the resistance value of voltage-division resistor 723C is "350Ω." Output extractor 723 converts the DC high voltage, which is outputted from rectifier circuit 722D, to a low voltage (for example, a voltage of "DC 3.3V" or less) by reducing the DC high voltage to "3.3/10200" of it through the voltage division. In this respect, the voltage obtained by the conversion by output extractor 723 is called an output analog voltage.

Comparator section 727 includes: RC filter 727A configured to smooth the low voltage which is outputted from output extractor 723; comparator 727D which is a voltage comparator to which the "24V" is applied from DC power source 54; and pull-up resistor 727E connected to the output terminal of comparator 727D. RC filter 727A includes: resistor 727B with a resistance of "10 kΩ"; and capacitor 727C with a capacitance of "0.01 μF." RC filter 727A smoothes the output analog voltage which is outputted from output extractor 723. Comparator 727D has: a negative input terminal through which the output analog voltage is received; and a positive input terminal through which the target analog voltage outputted from DAC 726 is received. Comparator 727D compares the voltage of the negative input terminal and the voltage of the positive input terminal, and gives a result of the comparison to printer engine controller 60 by outputting the result of the comparison via output port OUT11. The output terminal of comparator 727D is connected to regulator 724 through pull-up resistor 727E. In addition, although not illustrated, DC power source 54 is connected to one power source terminal of comparator 727D, and the other power source terminal of comparator 727D is grounded. Comparator 727D is operated with the single power source.

Figure 5:
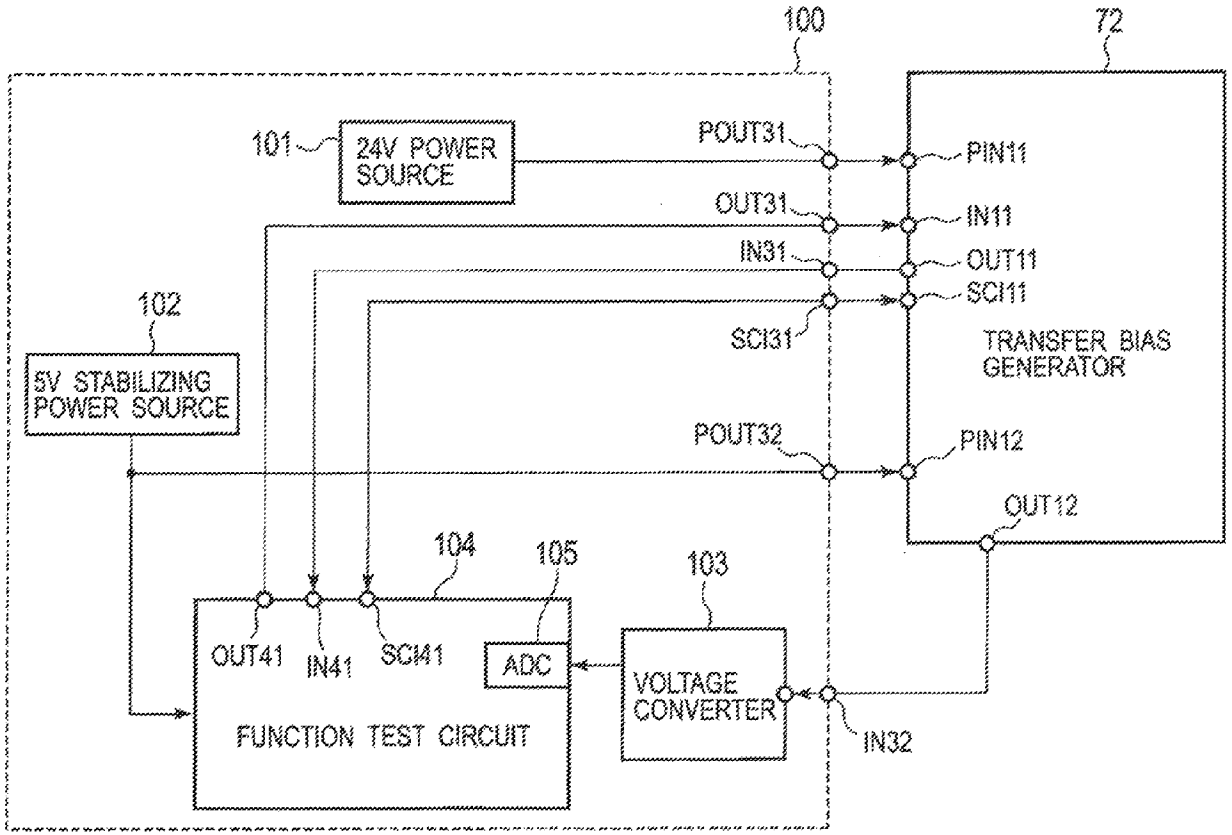
FIG. 5 is a block diagram schematically showing a configuration of a function tester of Embodiment 1.

FIG. 5 is a block diagram schematically showing a configuration of function tester 100. Function tester 100 makes necessary inputs to transfer bias generators 72, analyzes outputs from transfer bias generators 72, and thus causes the correspondence information to be stored in nonvolatile memories 725 of transfer bias generators 72.

Power source output port POUT31 is connected to power source input port PIN11 of each transfer bias generator 72. Power source 101 supplies DC 24V to transfer bias generator 72 via power source output port POUT31. Power source output port POUT32 is connected to power source input port PIN12 of transfer bias generator 72. Stabilizing power source 102 supplies "DC 5V" to transfer bias generator 72 via power source output port POUT32.

Input port IN32 is connected to output port OUT12 of transfer bias generator 72, and gives the high voltage, which is outputted from transfer bias generator 72, to voltage converter 103. Voltage converter 103 converts the high voltage, which is received via input port IN32, to a voltage which is "1/2000" of the high voltage. Voltage converter 103 can be realized by use of, for example, a high-voltage voltmeter.

Function test circuit 104 includes: analog-to-digital converter (hereinafter referred to as an "ADC") 105 with a 12-bit resolution; output port OUT41 connected to output port OUT31; input port IN41 connected to input port IN31; and serial port SCI41 connected to serial port SCI31. Function test circuit 104 sets a predetermined set value in DAC 726 of transfer bias generator 72 via serial ports SCI31, SCI41. Function test circuit 104 receives an analog voltage corresponding to a high voltage, which is actually outputted from transfer bias generator 72 in response to this set value, via input port IN32 and voltage converter 103. Thereby, function test circuit 104 generates correspondence information showing a correspondence relationship between the set value, which is set in DAC 726, and an output voltage value outputted from transfer bias generator 72. In this embodiment, for example, function test circuit 104 determines a linear function representing correspondence relationships between multiple set values and output voltage values actually outputted in response to the multiple set values, respectively. Function test circuit 104 makes a value representing the slope of this linear function and a value representing the intercept into the correspondence information. Incidentally, function test circuit 104 causes the thus-generated correspondence information to be stored in nonvolatile memory 725 of transfer bias generator 72 via serial ports SCI41, SCI31.

(Explanation of Operation)

Next, descriptions are provided for how the above-described image formation apparatus 1 works.

First of all, using FIGS. 1 and 2, descriptions are provided for how image formation apparatus 1 works as a whole. Image formation apparatus 1 receives the input of print data, which is described in PDL (Page Description Language) or the like, from an external apparatus (not illustrated) via host interface 51. The received print data is converted to bitmap data by command/image processor 52.

Image formation apparatus 1 raises the temperature of the thermal fixation roller of fixation unit 18 to a predetermined temperature by controlling fixation unit heater 85 in accordance with the detection value of thermistor 86. Thereafter, image formation apparatus 1 starts its printing operation.

Subsequently, image formation apparatus 1 feeds one of sheets 15, which are set in sheet cassette 13, by use of hopping roller 14. Sheet 15 is carried onto transfer belt 8 by register rollers 16, 17 at a timing synchronized with image forming operation, which is described later. Development units 2 form the toner images on photosensitive drums 32 inside development units 2 through the electrophotographic process. To this end, LED heads 3 are lit in accordance with the bitmap data. The toner images developed by development units 2 are transferred to sheet 15 conveyed on transfer belt 8 by the biases applied to transfer rollers 5. After the toner images are transferred to sheet 15, the toner images are fixed onto sheet 15 by fixation unit 18, and resultant sheet 15 is delivered. Toner cartridges 4 have the structure which enables toner cartridges 4 to be detachably attached to development units 2, and which enables the toners in the inside of toner cartridges 4 to be supplied to development units 2. Printer engine controller 60 sets high voltages to be outputted, on the basis of a value in a table which is previously determined in accordance with the value of temperature/humidity sensor 89.

Next, using FIG. 3, descriptions are provided for a process in which the high voltage outputted from transfer bias generator 72 is controlled. In this embodiment, the four high voltages need to be outputted for the respective four colors. Because, however, the processes for the respective colors are identical to one another, descriptions are provided for only the process for one color. Incidentally, as shown in FIG. 6, the transfer bias is controlled in a range of "130V to 7410V" corresponding to the set values "00hex to FFhex" which are set in DAC 726. In this respect, the set values set in DAC 726 and the corresponding output voltage values, which are shown in FIG. 6, represent 8-bit values set in DAC 726 as shown in FIG. 4 and actually-measured values obtained by measuring the voltage at a point indicated with reference sign X in FIG. 4 by use of the high-voltage voltmeter, respectively. Incidentally, image formation apparatus 1 works with the transfer bias set in a range of "1000V to 7000V." In FIG. 6, the reason why the output voltage values are constant when the set values set in DAC 726 are "C5hex" or larger is that a lower limit is set on the frequency of the rectangular wave outputted from output port OUT21 of printer engine controller 60. Note that because the frequency control of printer engine controller 60 is the same as that which is performed in the conventional practice, detailed descriptions for the frequency control are omitted.

Printer engine controller 60 outputs the rectangular wave with an average frequency of "130 kHz to 108 kHz" from output port OUT21, and thereby drives piezoelectric transducer driver circuit 721. The drive starting frequency is 130 kHz.

Molded piezoelectric transfer section 722 rectifies the AC output from the secondary side of the piezoelectric transducer in the rectifier circuit, and applies the bias to the transfer roller shaft which is output load 61.

Output extractor 723 drops the high-voltage output to the low voltage of "3.3V" or less through the resistance voltage division, and gives the low voltage to comparator section 727 as the output analog voltage.

In addition, printer engine controller 60 acquires the environment in which images are formed from temperature/humidity sensor 87 (see FIG. 2), and determines the transfer bias on the basis of a combination of the environment, data on the number of copies to be printed, data on the printing speed, and the like. Thereafter, on the basis of the thus-determined transfer bias and the correspondence information stored in nonvolatile memory 725, printer engine controller 60 determines the 8-bit set value to be set in DAC 726, and sends this set value to DAC 726 via serial port SCI21. DAC 726 outputs the target analog voltage, which corresponds to the set value acquired via serial port SCI11, to comparator section 727.

Comparator section 727 smoothes the output analog voltage given from output extractor 723 in the RC filter, and thereafter compares the resultant output analog voltage and the target analog voltage given from DAC 726. If the output analog voltage is lower than the target analog voltage, comparator section 727 outputs a H-level (3.3V) voltage as a result of the comparison. If the output analog voltage is higher than the target analog voltage, comparator section 727 outputs a L-level (0.0V) voltage as a result of the comparison. In this respect, even though the output analog voltage is rectified by the rectifier circuit and smoothed by the RC filter, the output analog voltage vibrates with a frequency which is identical to the rectangular wave outputted from output port OUT21 of printer engine controller 60. As a result, if the output analog voltage and the target analog voltage are almost equal to each other, the output from comparator 727D takes on a rectangular wave. For this reason, printer engine controller 60 controls the frequency of the rectangular wave to be outputted from output port OUT21 in order that the input into input port IN21 should take on a rectangular wave, in other words, in order that the output analog voltage and the target analog voltage are almost equal to each other. The frequency control circuit included in printer engine controller 60 is built in an integrated circuit which is the same as other LSIs used for image formation and the like.

Next, detailed descriptions are provided using FIG. 4. In this respect, let us assume that printer engine controller 60 determines the set voltage value of, for example, "5000V" as the transfer bias. First of all, printer engine controller 60 converts the "5000V" determined as the transfer bias to digital data (1388hex), and holds the digital data in memory 601. Subsequently, printer engine controller 60 reads the first value and the second value, which are respectively stored in the addresses "00hex" and "01hex" in nonvolatile memory 725, via serial port SCI21. In this event, data (the first value) stored in the address "00hex" is "25hex(37)," while data (the second value) stored in the address "01hex" is "19hex(25)." Incidentally, descriptions are provided for these values later. Thereafter, on the basis of the first value and the second value, print engine controller 60 calculates the set value to be set in DAC 726 from the set voltage value.

Figure 7:
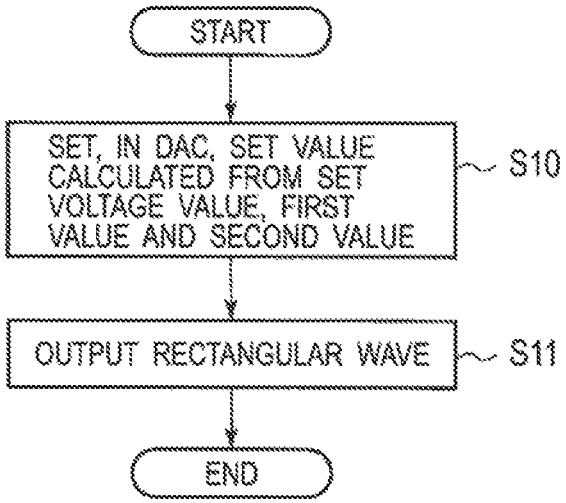
FIG. 7 is a flowchart showing a process in which a printer engine controller of Embodiment 1 sets a set value in a DAC, and outputs a rectangular wave.

FIG. 7 is a flowchart showing a process in which printer engine controller 60 sets a set value in DAC 726 and thus outputs a rectangular wave. The process in the flowchart shown in FIG. 7 starts when, for example, the user gives a print instruction to image formation apparatus 1.

First of all, printer engine controller 60 calculates a value (representing the nearest whole number rounded by counting fractions of 0.5 or over as a unit and cutting away the rest) using Expression (2) given below, and sets the thus-calculated value, as the set value, in DAC 726 via serial ports SCI21, SCI11 (in step S10).

$$[(\text{set voltage value})-(\text{second value})]\div(\text{first value}) \qquad \text{Ex. (2)}$$

When the values are inputted into Expression (2), the following calculation is performed on Expression (2).

$$(1388\text{hex}-19\text{hex})\div 25\text{hex}=(5000-25)\div 37=134.46$$

Subsequently, printer engine controller 60 sets a value (134=86hex) representing the nearest whole number rounded by counting fractions of 0.5 or over as a unit and cutting away the rest, as the set value, to be set in DAC 726.

Thereafter, printer engine controller 60 generates the rectangular wave by dividing the frequency of the clock signal from, for example, an oscillator (not illustrated), and outputs this rectangular wave from output port OUT21. Printer engine controller 60 controls the frequency of the rectangular wave outputted from output port OUT21 in order that the input into input port IN21 should take on a rectangular wave (in step S11).

Let us return to the explanation using FIG. 4. In accordance with the flow shown in FIG. 7, the set value "B8hex" is set in DAC 726, and the high voltage is outputted from molded piezoelectric transducer section 722. Once the set value "86hex(134)" is set there, DAC 726 outputs an analog voltage of "1.73V," which is obtained by a calculation using Expression (3) given below, to the "positive" terminal of comparator 727D as the target analog voltage.

$$3.3\text{V}\times(134\div 255)=1.73\text{V} \qquad \text{Ex. (3)}$$

After setting the set value in DAC 726, printer engine controller 60 outputs the rectangular wave, which is the pulse for driving piezoelectric transducer 722A, from output port OUT21.

The drive starting frequency of the rectangular wave outputted from printer engine controller 60 is "130 kHz." The resonance circuit formed from inductor 721C, capacitor 721D and piezoelectric transducer 722A is driven by NMOS 721A. As a result, an output of "130V" is outputted from molded piezoelectric transducer section 722. The outputted voltage is dropped to "3.3/10200" of it through the voltage division using voltage-division resistor 723A of the "100 MΩ," voltage-division resistor 723B of the "32 kΩ," and voltage-division resistor 723C of the "350Ω." Ripples are removed from the output analog voltage, which is dropped to the low voltage through the voltage division, by RC filter 727A formed from resistor 727B and capacitor 727C. The resultant output analog voltage is inputted into the "negative" terminal of comparator 727D.

In this event, because the output analog voltage is smaller than the target analog voltage, the output from comparator 727D is an open collector output. Accordingly, the "3.3V" obtained by the pull-up by pull-up resistor 727E, namely the H-level signal, is outputted from output port OUT11. For this reason, printer engine controller 60 decreases the frequency of the rectangular wave to be outputted from output port OUT21. Thereafter, once the output from molded piezoelectric transducer section 722 becomes equal to the "5000V," the output from comparator 727D takes on the rectangular wave.

In the case where the output from molded piezoelectric transducer section 722 becomes equal to the "5000V," the output analog voltage obtained by the voltage division using voltage-division resistors 723A, 723B, 723C becomes equal to "1.62V" in accordance with Expression (4) given below.

$$5000\text{V}\times 3.3\div 10200=1.62\text{V} \qquad \text{Ex. (4)}$$

This value is different from the target analog voltage value (1.73V) shown by Expression (3). However, the output analog voltage value is a calculated value, but not a measured value. In a case where the set value corresponding to the set voltage value is not calculated from a measured value, the value at the address "00hex" is "28hex(40)," and the value at the address "01hex" is "00hex(0)." In this case, the set value in the DAC 726 is "7Dhex(125)" in accordance with Expression (5) given below.

$$(5000V-0)\div 40=125=7D\text{hex} \quad \text{Ex. (5)}$$

In this case, the target analog voltage is "1.62V" in accordance with Expression (6) given below, and becomes equal to the output analog voltage value.

$$3.3V\times(125\div 255)=1.62V \quad \text{Ex. (6)}$$

Next, using FIG. 5, descriptions are provided for the correspondence information. For example, when a board corresponding to each transfer bias generator 72 is produced, function tester 100 is attached to the board. Thereby, for each board, function tester 100 calculates the first value and the second value, as well as causes the first value and the second value to be stored in nonvolatile memory 725 (see FIG. 3).

First of all, function tester 100 supplies the "DC 5V" to transfer bias generator 72 from stabilizing power source 102, and the "DC 24V" to transfer bias generator 72 from power source 101. Then, function test circuit 104 sets the previously-determined set value in DAC 726 of transfer bias generator 72 via serial ports SCI41, SCI31. Subsequently, function test circuit 104 causes the high voltage corresponding to the set value set in DAC 726 to be outputted from transfer bias generator 72 by controlling the frequency of the rectangular wave outputted from output ports OUT41, OUT31 by use of a frequency control circuit, which is the same as the frequency control circuit included in printer engine controller 60. Thereafter, function tester 100 calculates the first value and the second value from the relationship between the set value set in DAC 726 and the high voltage outputted from transfer bias generator 72.

Figure 8:
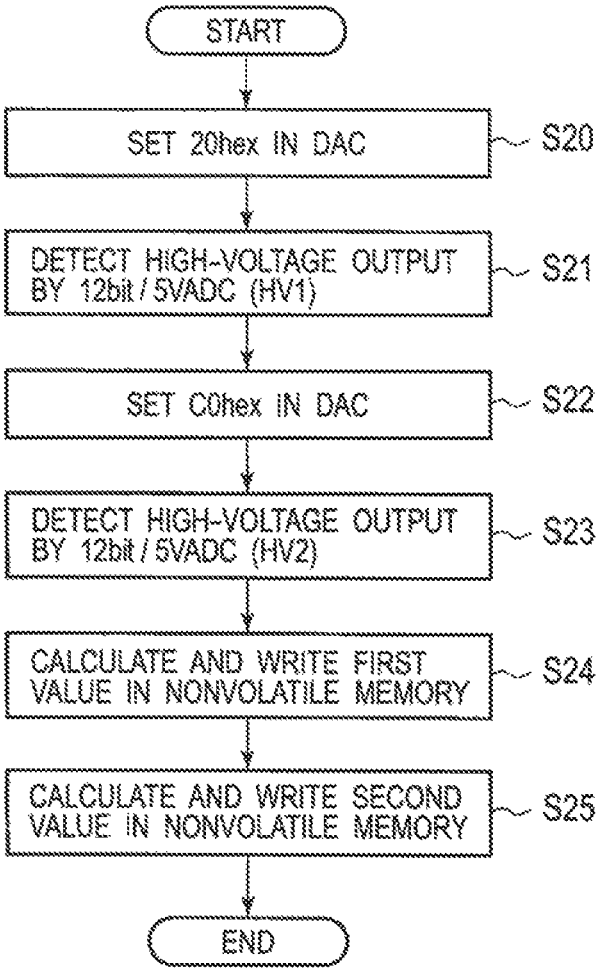
FIG. 8 is a flowchart showing a process carried out by the function tester of Embodiment 1.

FIG. 8 is a flowchart showing a process carried out by function tester 100. For example, function tester 100 starts the process in the flowchart shown in FIG. 8 when attached to the board corresponding to transfer bias generator 72.

First of all, function test circuit 104 sets a set value "20hex (32)" in DAC 726 of transfer bias generator 72 via serial ports SCI41, SCI31 (in step S20).

Then, function test circuit 104 controls the frequency of the rectangular wave outputted from output ports OUT41, OUT31 in order that the signal received via input ports IN31, IN41 should take on a rectangular wave. Subsequently, voltage converter 103 receives the high voltage outputted from transfer bias generator 72 via input port IN32, and drops the high voltage to "1/2000" of it, thus giving the resultant voltage to ADC 105. ADC 105 converts the given voltage to a digital value with 12-bit resolution with which "5V" is digitized. Thereafter, function test circuit 104 holds the converted digital value as a first detection value HV1 (in step S21). When, for example, the set value in DAC 726 is "20hex," the output voltage from transfer bias generator 72 is "1210V," as shown in FIG. 6. Voltage converter 103 drops this output voltage "1210V" to "1/2000" of it, which is "0.605V." ADC 105 converts the voltage "0.605V" to a digital value (495=1EFhex). Function test circuit 104 holds this digital value (1EFhex) as first detection value VH1.

Subsequently, function test circuit 104 sets a set value "C0hex (192)" in DAC 726 of transfer bias generator 72 via serial ports SCI11, SCI31 (in step S22).

Afterward, function test circuit 104 controls the frequency of the rectangular wave outputted from output ports OUT41, OUT31 in order that the signal received via input ports IN31, IN41 should take on a rectangular wave. Subsequently, voltage converter 103 receives the high voltage outputted from transfer bias generator 72 via input port IN32, and drops the high voltage to "1/2000" of it, thus giving the resultant voltage to ADC 105. ADC 105 converts the given voltage to a digital value with 12-bit resolution with which "5V" is digitized. Thereafter, function test circuit 104 holds the converted digital value as a second detection value HV2 (in step S23). When, for example, the set value in DAC 726 is "C0hex," the output voltage from transfer bias generator 72 is "7190V," as shown in FIG. 6. Voltage converter 103 drops this output voltage "7190V" to "1/2000" of it, which is "3.595V." ADC 105 converts the voltage "3.595V" to a digital value (2944=B80hex). Function test circuit 104 holds this digital value (B80hex) as second detection value HV2.

Subsequently, function test circuit 104 writes a value (representing the nearest whole number rounded by counting fractions of 0.5 or over as a unit and cutting away the rest), which is calculated using Expression (7) given below, as the first value, at the address "00hex" in nonvolatile memory 725 of transfer bias generator 72 via serial ports SCI41, SCI31 (in step S24).

$$[(HV2)-(HV1)-2000\times 5\div 4095]\div 160 \quad \text{Ex. (7)}$$

For example, when the values are inputted into the Expression (7), $$[(2944)-(495)\times 2000\times 5\div 4095]\div 160=37.37.$$

When this value is rounded to the nearest whole number by counting fractions of 0.5 or over as a unit and cutting away the rest, the first value becomes equal to "25hex(37)."

Thereafter, function test circuit 104 writes a value (representing the nearest whole number rounded by counting fractions of 0.5 or over as a unit and cutting away the rest), which is calculated using Expression (8) given below, as the second value, at the address "01hex" in nonvolatile memory 725 of transfer bias generator 72 via serial ports SCI41, SCI31 (in step S25).

$$(HV1\times 2000\times 5\div 4095)-32\times(\text{first value}) \quad \text{Ex. (8)}$$

For example, when the values are inputted into the Expression (8), $$(495\times 2000\times 5\div 4095)-32\times 37=24.79.$$

When this value is rounded to the nearest whole number by counting fractions of 0.5 or over as a unit and cutting away the rest, the second value becomes equal to "19hex(25)."

As described above, function tester 100 is capable of causing transfer bias generator 72 to output the high voltage whose output is always corrected by: measuring the two high voltages corresponding to the two set values; and causing the value (first value) representing the slope and the value (second value) representing the intercept to be stored in nonvolatile memory 725.

The process in the flowchart shown in FIG. 8 is carried out when the board corresponding to transfer bias generator 72 is tested independently. After that, once this board is installed in image formation apparatus 1, image formation apparatus 1 is capable of realizing the stable high-voltage output which is not affected by manufacturing variation.

In the foregoing embodiment, a set value is calculated by linear approximation using two points. Alternatively, a set value may be determined from table-format information in which all the set values are associated with output voltage values corresponding to the set values. Otherwise, a set value may be calculated by another approximation using a cubic polynomial.

One characteristic of this invention is that transfer bias generator 72 is capable of always providing the same outputs no matter which of function tester 100 and image formation apparatus 1 is combined with transfer bias generator 72, because the reference voltage of transfer bias generator 72 or nonvolatile memory 725 is unchanged between the cases where transfer bias generator 72 is connected to function tester 100, and where transfer bias generator 72 is connected to image formation apparatus 1. Thereby, when the boards corresponding to transfer bias generators 72 are mass-produced, it is possible to always obtain the same high voltage outputs from transfer bias generators 72 even if the circuit components vary from one another. Accordingly, image formation apparatus 1 is capable of outputting stable images.

In Embodiment 1, as described above, DAC 726, regulator 724 and nonvolatile memory 725 are mounted on the same board; the value of the target analog voltage which should be outputted from the combination of DAC 726 and regulator 724 is calculated on the basis of values stored in nonvolatile memory 725; and accordingly, the output from transfer bias generator 72 is constant no matter how the board corresponding to transfer bias generator 72 and image formation apparatus 1 are combined with each other. For this reason, even when image formation apparatuses 1 are mass-produced, and even when the board corresponding to transfer bias generator 72 is replaced with a maintenance part, each image formation apparatus 1 is always capable of making the stable high-voltage outputs, and accordingly of easily outputting stable and high-quality images.

Furthermore, in Embodiment 1, the component for generating the drive pulse (rectangular wave) for piezoelectric transducer driver circuit 721 is placed outside the board corresponding to transfer bias generator 72. For this reason, this component can be mounted in the same LSI (for example, printer engine controller 60) as are the other integrated circuits for processing the respective images and the like. Accordingly, Embodiment 1 makes it possible to package densely the components for generating the respective drive pulses in the board or something similar for printer engine controller 60, for which a multi-layered glass epoxy board is used. In addition, Embodiment 1 makes it possible to use a clock frequency, which is fully lower than the clock frequency of several tens of MHz used in the LSI or something similar including the components for generating the respective drive pulses and the like, for example one hundred and several tens of kHz, as the frequency on the boards corresponding to transfer bias generators 72. For this reason, a shielding member or the like for inhibiting radiation noise can be made unnecessary.

Embodiment 2

Next, descriptions are provided for Embodiment 2.

(Explanation of Configuration)

Figure 9:
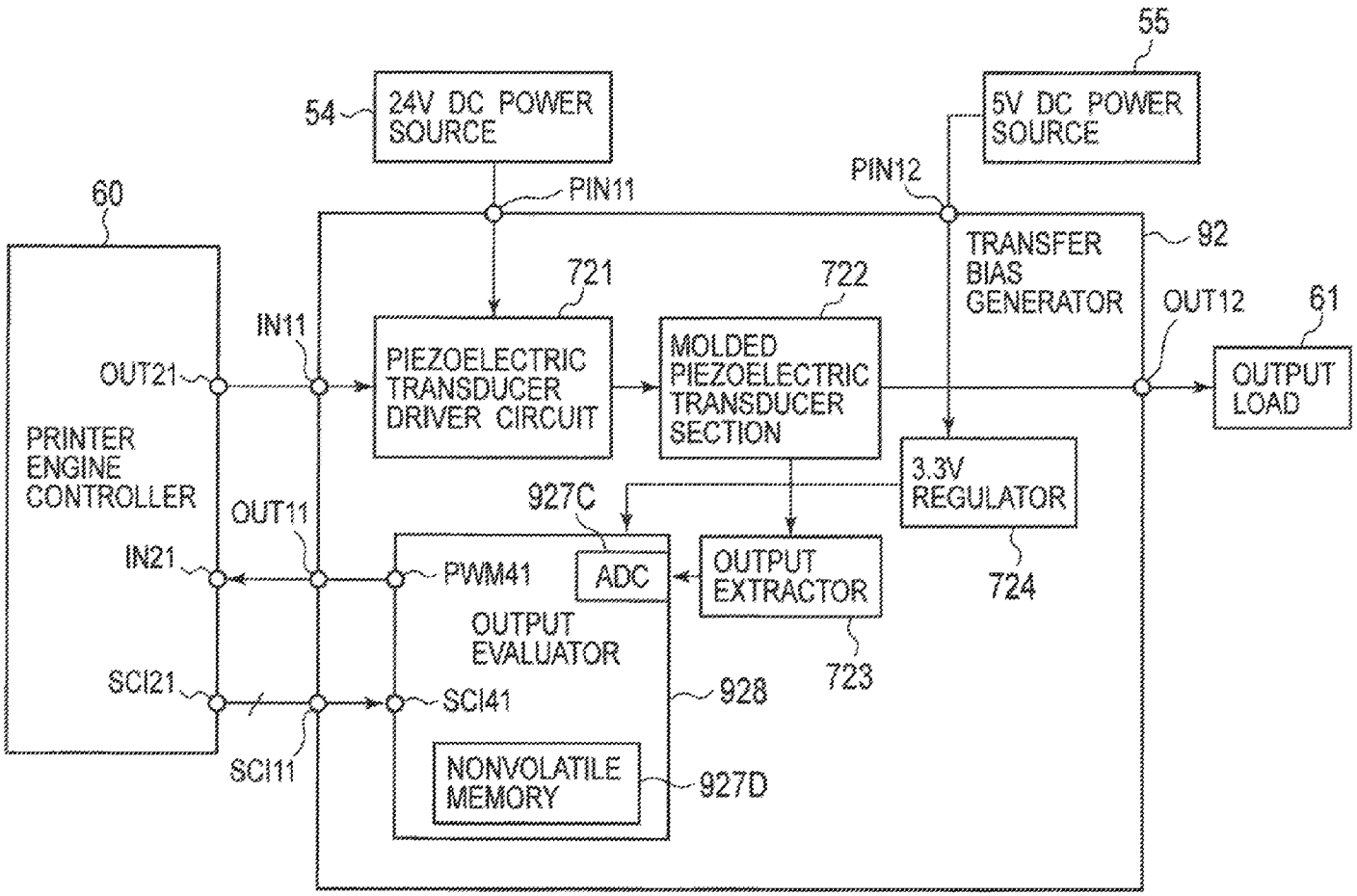
FIG. 9 is a block diagram schematically showing a configuration of a transfer bias generator of Embodiment 2.

FIG. 9 is a block diagram schematically showing transfer bias generator 92 of Embodiment 2. Transfer bias generator 92 of Embodiment 2 is different from transfer bias generator 72 of Embodiment 1 because of a configuration of output evaluator 928.

Output evaluator 928 of this embodiment converts the output analog voltage, which is received from output extractor 723, to a digital value with "8-bit" resolution. Subsequently, output evaluator 928 compares the thus-converted digital value with a set value of which printer engine controller 60 informs output evaluator 928, and outputs a signal indicating a result of the comparison via PWM port PWM41. PWM port PWM41 is connected to output port OUT11.

Figure 10:
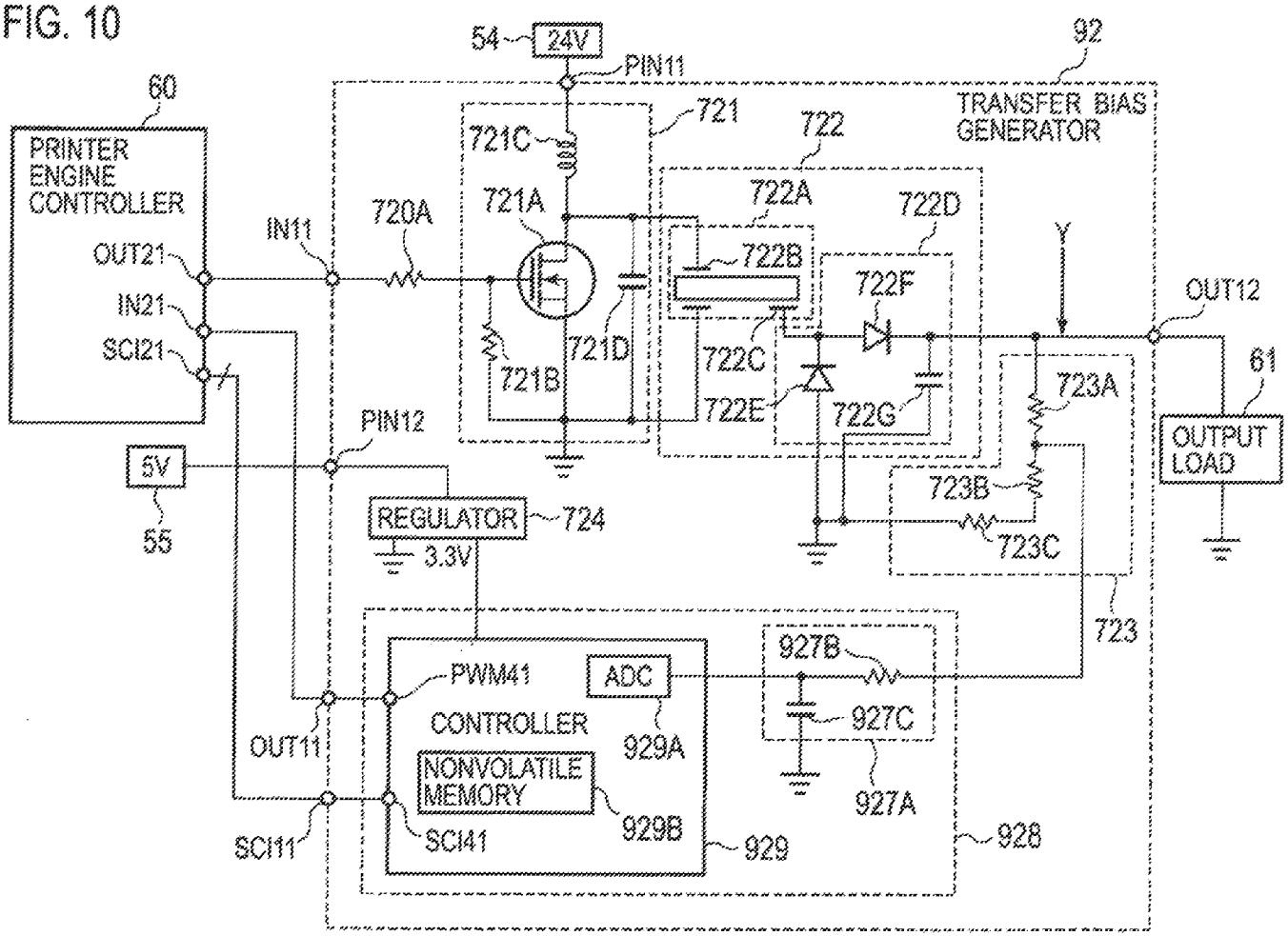
FIG. 10 is a circuit diagram schematically showing a circuit configuration of the transfer bias generator of Embodiment 2.

FIG. 10 is a circuit diagram schematically showing a circuit configuration of transfer bias generator 92 shown in FIG. 9. The circuit configuration of transfer bias generator 92 of Embodiment 2 is identical to the circuit configuration of transfer bias generator 72 shown in FIG. 4, except for output evaluator 928. For this reason, descriptions are hereinbelow provided for matters pertaining to output evaluator 928.

Output evaluator 928 includes: RC filter 927A for smoothing the low output analog voltage which is outputted from output extractor 723; and controller 929. RC filter 927A includes resistor 927B and capacitor 927C. RC filter 927A smoothes the output analog voltage outputted from output extractor 723. Incidentally, each of resistor 927B and capacitor 927C takes on a constant value which is more than 10 times as large as that in RC filter 727A of Embodiment 1.

Controller 929 includes: ADC 929A for converting the output analog voltage, which is smoothed by RC filter 927A, to a digital value with the "8-bit" resolution; and nonvolatile memory 929B. Once controller 929 receives an instruction from printer engine controller 60 via serial ports SCI41, SCI11, controller 929 writes information onto nonvolatile memory 929B, reads information stored in nonvolatile memory 929B, or rewrites information stored there, in accordance with the instruction. In this embodiment, a first value and a second value (correspondence information) used for printer engine controller 60 to calculate a set value from a set voltage value, as well as the set value given by printer engine controller 60, are stored in nonvolatile memory 929B.

Thereafter, controller 929 compares the set value which is set by printer engine controller 60 and the digital value (detection value) which is converted by ADC 929A. If the set value is smaller than the digital value, controller 929 outputs a H-level voltage via PWM port PWM41. If the set value is larger than the digital value, controller 929 outputs a L-level voltage via PWM port PWM41. If the set value can be judged as equal to the digital value, controller 929 outputs a rectangular wave with a frequency of "100 kHz" and with a duty of "37.5%" via PWM port PWM41. Incidentally, "3.3V" is supplied to controller 929 from regulator 724. This "3.3V" is a power supply for operating controller 929, and is also used as analog reference potential AVCC for ADC 929A. In addition, controller 929 has a built-in oscillator, and the clock frequency of the oscillator is "20 MHz." Note that: controller 929 can be realized by use of, for example, a CPU such as an 8-bit microcomputer or a 16-bit microcomputer which is commercially available; ADC 929A can be realized by the execution of the program by the microcomputer; and nonvolatile memory 929B can be realized by use of a flash ROM or PROM.

In Embodiment 2, too, function tester 100 shown in FIG. 5 sets a previously-determined set value in controller 929 of transfer bias generator 92, receives an analog voltage corresponding to the high voltage actually outputted from transfer bias generator 92 in response to this set value, and thus generates correspondence information showing a correspondence relationship between the set value set in controller 929 and the voltage value outputted from transfer bias generator 92. In this respect, the set values set in controller 929 and the output voltage values shown in FIG. 11 respectively show 8-bit values set in controller 929 shown in FIG. 10 and actually-measured voltage values corresponding to the set values, which are obtained by measuring the voltage at a point indicated by Y in FIG. 10 by use of a high-voltage voltmeter.

(Explanation of Operation)

Figure 12:
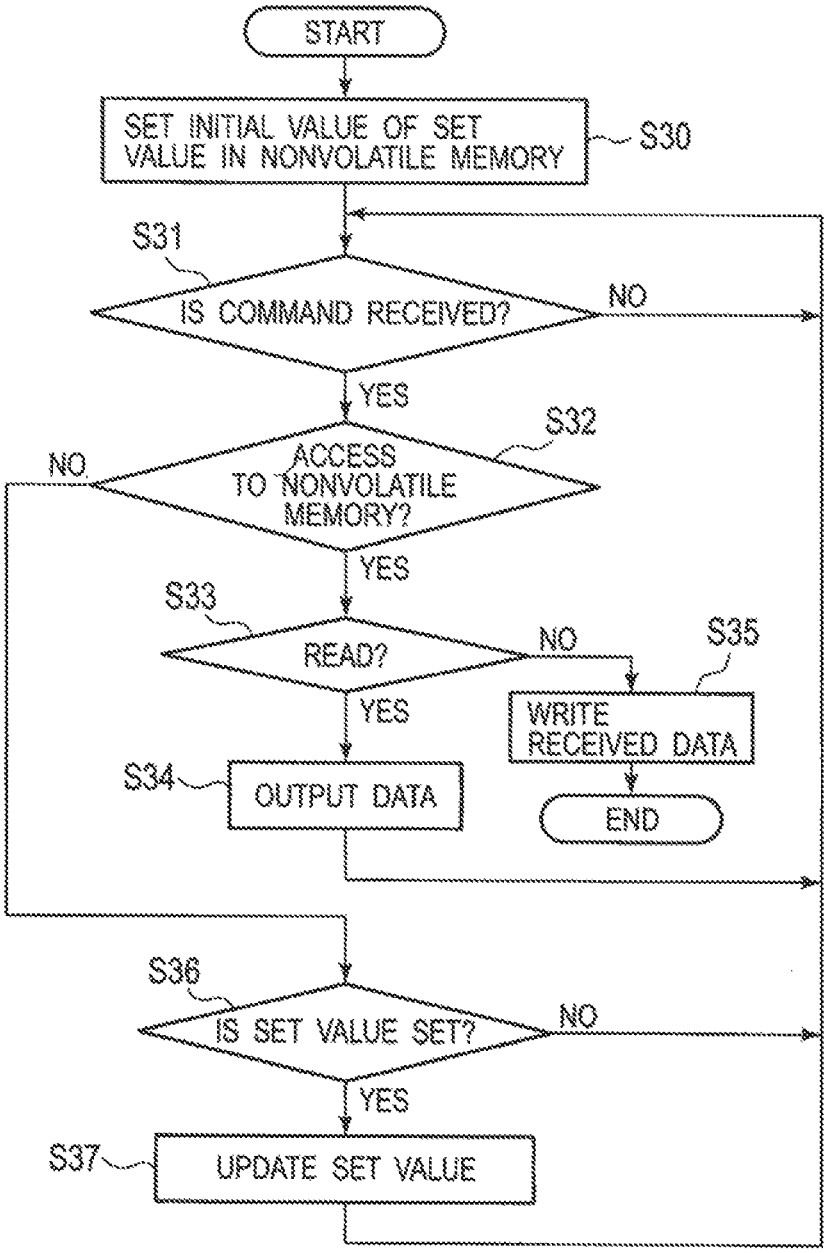
FIG. 12 is a flowchart showing a process in which a controller of an output evaluator of Embodiment 2 controls a nonvolatile memory.

FIG. 12 is a flowchart showing a process which is carried out by controller 929 of output evaluator 928 when controller 929 controls nonvolatile memory 929B.

First of all, controller 929 sets "00hex" in nonvolatile memory 929B as an initial value of the set value (in step S30).

Subsequently, if controller 929 receives a command from printer engine controller 60 via serial port SCI41 (if Yes in step S31), controller 929 proceeds to processing in step S32.

In step S32, controller 929 judges whether or not the command received in step S31 demands access to nonvolatile memory 929B. If the command demands the access to nonvolatile memory 929B (if Yes in step S32), controller 929 proceeds to processing in step S33. If the command does not demand the access to nonvolatile memory 929B (if No in step S32), controller 929 proceeds to processing in step S36.

In step S33, controller 929 judges whether or not the command received in step S31 requests data to be read from nonvolatile memory 929B. If the command requests data to be read from nonvolatile memory 929B (if Yes in step S33), controller 929 proceeds to processing in step S34. If the command does not request data to be read from nonvolatile memory 929B (if No in step S33), controller 929 proceeds to processing in step S35. In step S34, controller 929 reads the data designated by the command from nonvolatile memory 929B, and outputs this data via serial port SCI41. For example, the processing in step S34 includes processing for reading and outputting the first value and the second value stored at the addresses "00hex" and "01hex" in nonvolatile memory 929B. On the other hand, in step S35, controller 929 carries out processing for writing data received via serial port SCI41 into nonvolatile memory 929B. For example, the processing in step S35 includes processing for writing the first value and the second value at the addresses "00hex" and "01hex" in nonvolatile memory 929B.

Meanwhile, in step S36, controller 929 judges whether or not the command received in step S31 requests the set value to be set in nonvolatile memory 929B. If the command requests the set value to be set there (if Yes in step S36), controller 929 proceeds to processing in step S37. If the command does not request the set value to be set there (if No in step S36), controller 929 returns to the processing in step S31. In step S37, controller 929 writes the set value received via serial port SCI41 into nonvolatile memory 929B.

It should be noted that the processing in step S35 in FIG. 12 is that which is carried out only while function tester 100 is connected to the board corresponding to transfer bias generator 92. In addition, while the processing in step S35 is being carried out, function test circuit 104 outputs no rectangular wave via serial port SCI41. Furthermore, function test circuit 104 does not carry out the processing in step S37 while function test circuit 104 is outputting the rectangular wave via serial port SCI41.

Figure 13:
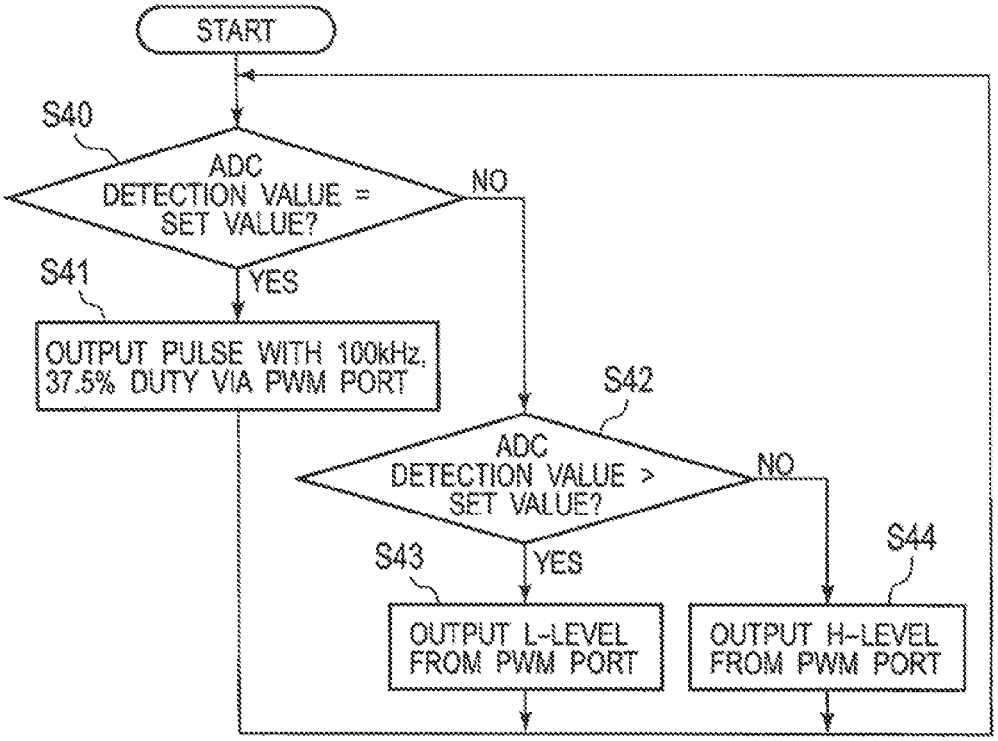
FIG. 13 is a flowchart showing a process in which the controller of the output evaluator of Embodiment 2 carries out an output voltage evaluation.

FIG. 13 is a flowchart showing a process in which controller 929 of output evaluator 928 carries out an output voltage evaluation. The process in the flowchart shown in FIG. 13 is started when the output analog voltage is inputted into ADC 929A, and is always carried out while the input of the output analog voltage into ADC 929A continues.

First of all, controller 929 judges whether or not the digital value (ADC detection value) obtained by the conversion by ADC 929A is equal to the set value stored in nonvolatile memory 929B (in step S40). If the digital value is equal to the set value (if Yes in step S40), controller 929 proceeds to processing in step S41. If the digital value is not equal to the set value (if No in step S40), controller 929 proceeds to processing in step S42.

In step S41, controller 929 outputs the rectangular wave with a frequency of "100 kHz" and with a duty of "37.5%" via PWM port PWM41. In this respect, because controller 929 operates at "20 MHz," this rectangular wave becomes a pulse with a period of 200 clock cycles and with 75 clock cycles in a high period of time.

On the other hand, in step S42, controller 929 judges whether or not the digital value obtained by the conversion by ADC 929A is larger than the set value stored in nonvolatile memory 929B. If the digital value is larger than the set value (if Yes in step S42), controller 929 proceeds to processing in step S43. If the digital value is smaller than the set value (if No in step S42), controller 929 proceeds to processing in step S44.

In step S43, controller 929 outputs the L-level voltage via PWM port PWM41. Meanwhile, in step S44, controller 929 outputs the H-level voltage via PWM port PWM41.

As described above, in Embodiment 2, too, the detection of the digital value, as well as the comparison between the digital value and the set value, is carried out in real time while the high voltage is being outputted; and the output from PWM port PWM41 becomes almost equal to the output from comparator 727D of Embodiment 1. In Embodiment 2, however, the frequency of the output from PWM port PWM41 is fixed to the "100 kHz," and the high period of time per unit time falls within the range of 25% to 50% of the period of the drive pulse inputted into the piezoelectric transducer although not synchronized with the drive pulse. For this reason, printer engine controller 60 of Embodiment 2 is capable of making controls in the same way as printer engine controller 60 of Embodiment 1.

In Embodiment 2, although the piezoelectric transducer drive pulse is generated in printer engine controller 60, a configuration may be employed in which this pulse is generated in output evaluator 928 instead.

The foregoing descriptions are provided for Embodiments 1 and 2 in which transfer bias generators 72, 92 are the high-voltage power supply devices for image formation apparatus 1 of a color-tandem type. However, transfer bias generators 72, 92 may be high-voltage power supply devices for monochrome image formation apparatuses. Furthermore, the invention may be also applied to bias sources for the charging, the developing and the like other than the transferring.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A power supply device comprising:

a voltage output unit configured to output a DC voltage corresponding to a control signal from a first controller;

an output extractor configured to output an output analog voltage, the output analog voltage being a voltage that is decreased at a certain ratio from the DC voltage output from the voltage output unit;

an output evaluator configured to perform a judgment process of judging whether or not the DC voltage is a voltage corresponding to a set value received from the first controller, and to output a result of the judgment to the first controller;

a constant voltage generator configured to generate a constant voltage and output the constant voltage to the output evaluator; and a board having the voltage output unit, the constant voltage generator and the output evaluator provided thereon, wherein the output evaluator includes:

a storage for storing correspondence information which shows a correspondence relationship between the set value and a voltage value of the DC voltage outputted from the voltage output unit, the storage also provided on the board, a target output voltage unit configured to read the correspondence information stored in the storage, output the correspondence information to the first controller, receive the set value determined based on the correspondence information by the first controller and receive the constant voltage output from the constant voltage generator, create an analog voltage, as a target analog voltage, in accordance with the received set value and based on the constant voltage, and output the target analog voltage, and a comparator section configured to compare the output analog voltage and the target analog voltage, and output a comparison result to the first controller, and the output evaluator is configured to perform the judgment process by: outputting the correspondence information to the first controller; and receiving a set value determined on the basis of the correspondence information from the first controller, wherein the correspondence information is preset and is based on measured circuit component characteristics of the board, and wherein the correspondence information of the board differs from the respective correspondence information of another board due to manufacturing variations of the board as compared to the another board.

2. The power supply device according to claim 1, wherein the first controller is not placed on the board.

3. The power supply device according to claim 1, wherein the correspondence information is information for determining a function between the set value and the voltage value of the DC voltage outputted from the voltage output unit.

4. The power supply device according to claim 1, wherein the constant voltage generator receives a voltage from a voltage supply that is not provided on the board, and wherein the constant voltage generator outputs the constant voltage having a constant voltage level to the output evaluator.

5. The power supply device according to claim 1, wherein the correspondence information is preset at a time of manufacture of the board.

6. The power supply device according to claim 1, wherein the correspondence information is table-format information showing: voltage values of DC voltages outputted from the voltage output unit; and set values corresponding to the voltage values.

7. The power supply device according to claim 1, wherein the voltage output unit includes:

a piezoelectric transducer driver configured to output a driving voltage corresponding to the control signal;

a piezoelectric transducer configured to output an AC voltage by raising the driving voltage; and a converter configured to convert the AC voltage to a DC voltage, and at least the piezoelectric transducer is molded with an insulating member.

8. An image formation apparatus comprising:

a first controller configured to output a control signal; and a power supply device, wherein the power supply device includes:

a voltage output unit configured to output a DC voltage corresponding to the control signal from the first controller;

an output extractor configured to output an output analog voltage, the output analog voltage being a voltage that is decreased at a certain ratio from the DC voltage output from the voltage output unit;

an output evaluator configured to perform a judgment process of judging whether or not the DC voltage is a voltage corresponding to a set value received from the first controller, and to output a result of the judgment to the first controller;

a constant voltage generator configured to generate a constant voltage and output the constant voltage to the output evaluator; and a board having the voltage output unit, the constant voltage generator and the output evaluator provided thereon, and the output evaluator includes:

a storage for storing correspondence information which shows a correspondence relationship between the set value and a voltage value of the DC voltage outputted from the voltage output unit, the storage also provided on the board, a target output voltage unit configured to read the correspondence information stored in the storage, output the correspondence information to the first controller, receive the set value determined based on the correspondence information by the first controller and receive the constant voltage output from the constant voltage generator, create an analog voltage, as a target analog voltage, in accordance with the received set value and based on the constant voltage, and output the target analog voltage, and a comparator section configured to compare the output analog voltage and the target analog voltage, and output a comparison result to the first controller, and the output evaluator is configured to perform the judgment process by: outputting the correspondence information to the first controller; and receiving a set value determined on the basis of the correspondence information from the first controller, and the first controller controls the control signal in accordance with a result of the judgment, wherein the correspondence information is preset and is based on measured circuit component characteristics of the board, and wherein the correspondence information of the board differs from the respective correspondence information of another board due to manufacturing variations of the board as compared to the another board.

9. The image formation apparatus according to claim 8, wherein the first controller is not placed on the board.

10. The image formation apparatus according to claim 8, wherein the correspondence information is information for determining a function between the set value and the voltage value of the DC voltage outputted from the voltage output unit.

11. The image formation apparatus according to claim 8, wherein the constant voltage generator receives a voltage from a voltage supply that is not provided on the board, and wherein the constant voltage generator outputs the constant voltage having a constant voltage level to the output evaluator.

12. The image formation apparatus according to claim 8, wherein the correspondence information is preset at a time of manufacture of the board.

13. The image formation apparatus according to claim 8, wherein the correspondence information is table-format information showing: voltage values of DC voltages outputted from the voltage output unit; and set values corresponding to the voltage values.

14. The image formation apparatus according to claim 8, wherein the voltage output unit includes:

a piezoelectric transducer driver configured to output a driving voltage corresponding to the control signal;

a piezoelectric transducer configured to output an AC voltage by raising the driving voltage; and a converter configured to convert the AC voltage to a DC voltage, and at least the piezoelectric transducer is molded with an insulating member.

15. The power supply device according to claim 1, wherein the comparator section comprises: an RC filter configured to smooth the output analog voltage output from the output extractor;

a comparator configured to compare the smoothed output analog voltage and the target analog voltage; and a pull-up resistor connected to an output terminal of the comparator.

16. The image formation apparatus according to claim 8, wherein the comparator section comprises: an RC filter configured to smooth the output analog voltage output from the output extractor; a comparator configured to compare the smoothed output analog voltage and the target analog voltage; and a pull-up resistor connected to an output terminal of the comparator.

17. A power supply device comprising:

a voltage output unit configured to output a DC voltage corresponding to a control signal from a first controller;

an output extractor configured to output an output analog voltage, the output analog voltage being a voltage that is decreased at a certain ratio from the DC voltage output from the voltage output unit, an output evaluator configured to perform a judgment process of judging whether or not the DC voltage is a voltage corresponding to a set value received from the first controller, and to output a result of the judgment to the first controller; and a constant voltage generator configured to receive a voltage from a power supply and to generate a constant voltage and output the constant voltage to the output evaluator, wherein the output evaluator includes:

a storage for storing correspondence information which shows a correspondence relationship between the set value and a voltage value of the DC voltage outputted from the voltage output unit, a target output voltage unit configured to read the correspondence information stored in the storage, output the correspondence information to the first controller, receive the set value determined based on the correspondence information by the first controller and receive the constant voltage output from the constant voltage generator, create an analog voltage, as a target analog voltage, in accordance with the received set value and based on the constant voltage, and output the target analog voltage, and a comparator section configured to compare the output analog voltage and the target analog voltage, and output a comparison result to the first controller, and the output evaluator is configured to perform the judgment process by: outputting the correspondence information to the first controller, and receiving a set value determined on the basis of the correspondence information from the first controller.

18. The power supply device according to claim 17, wherein the output evaluator and the constant voltage generator are provided on the same board.

19. The power supply device according to claim 18, wherein the constant voltage output from the constant voltage generator is supplied to the comparator, the digital analog convertor, and the storage.

20. The power supply device according to claim 18, wherein the voltage value of the DC voltage outputted from the voltage output unit is determined based on the correspondence information stored in the storage and a target voltage outputted by a combination of the digital analog convertor and the constant voltage generator.

21. An image formation apparatus, comprising:

the power supply device according to claim 17.

22. The power supply device according to claim 17, wherein the correspondence information is information for determining a function between the set value and the voltage value of the DC voltage outputted from the voltage output unit.

23. The power supply device according to claim 22, wherein the power supply is not provided on the board, and wherein the constant voltage generator outputs the constant voltage having a constant voltage level to the output evaluator.

24. The power supply device according to claim 23, wherein the correspondence information includes a slope and an intercept of a linear function.

25. The power supply device according to claim 17, wherein the correspondence information is table-format information showing: voltage values of DC voltages outputted from the voltage output unit; and set values corresponding to the voltage values.

26. The power supply device according to claim 17, wherein the output evaluator includes a second controller configured to determine a voltage value of the output analog voltage, and to compare the voltage value with the set value.

27. The power supply device according to claim 17, wherein the voltage output unit includes:

a piezoelectric transducer driver configured to output a driving voltage corresponding to the control signal;

a piezoelectric transducer configured to output an AC voltage by raising the driving voltage; and a converter configured to convert the AC voltage to a DC voltage, and at least the piezoelectric transducer is molded with an insulating member.

* * * * *